United States Patent [19]

Gordon

[11] 4,073,475

[45] Feb. 14, 1978

[54] CHAIN LINK FENCE STRAIGHTENER

[75] Inventor: Steven R. Gordon, Yakima, Wash.

[73] Assignee: Fred C. Van Hoose, Yakima, Wash. ; a part interest

[21] Appl. No.: 694,688

[22] Filed: June 10, 1976

[51] Int. Cl.[2] ..... B66F 3/08; B21F 33/00

[52] U.S. Cl. ..... 254/66; 140/108; 254/83; 254/97

[58] Field of Search ..... 140/16, 108, 109; 254/66, 83, 97, 133 R; 256/37, 40; 269/48.1, 272

[56] References Cited

U.S. PATENT DOCUMENTS

| | | | |
|---|---|---|---|
| 624,730 | 5/1899 | Barnes | 140/108 |
| 838,911 | 12/1906 | Seacrist | 254/133 R |
| 989,744 | 4/1911 | Wilmot | 254/97 |
| 1,406,302 | 2/1922 | Tobias | 254/133 R |
| 2,099,487 | 11/1937 | Johnson et al. | 254/133 R |
| 2,587,889 | 3/1952 | Picton | 140/109 |
| 2,630,297 | 3/1953 | Hunz | 254/133 R |
| 3,313,523 | 4/1967 | Reynolds | 254/133 R |
| 3,591,140 | 7/1971 | McCoy | 254/66 |
| 3,758,077 | 9/1973 | Fisher | 254/133 R |
| 3,834,669 | 9/1974 | Reid | 254/133 R |
| 3,921,958 | 11/1975 | Brockelsby et al. | 254/97 |

*Primary Examiner*—E. M. Combs

*Attorney, Agent, or Firm*—Graybeal, Barnard & Uhlir

[57] ABSTRACT

Chain link fence straightener apparatus usable to restore bent chain link fence sections or segments without removal thereof from the fence, and including lower and upper tine means arranged on an upright post supported by a ground engageable base member, such upper tine means being movable vertically on a carriage vertically shifted along the post through means of a rack gear on the post and pinion gear means on the carriage, said lower and upper tine means being of substantial horizontal span to engage a plurality of links of the fence at various points along the fence. In preferred form the rack gear on the post is made up of a length of hardened steel chain links and is readily removable and adjustable in tension by means of a threaded anchor bolt at its lower end.

15 Claims, 3 Drawing Figures

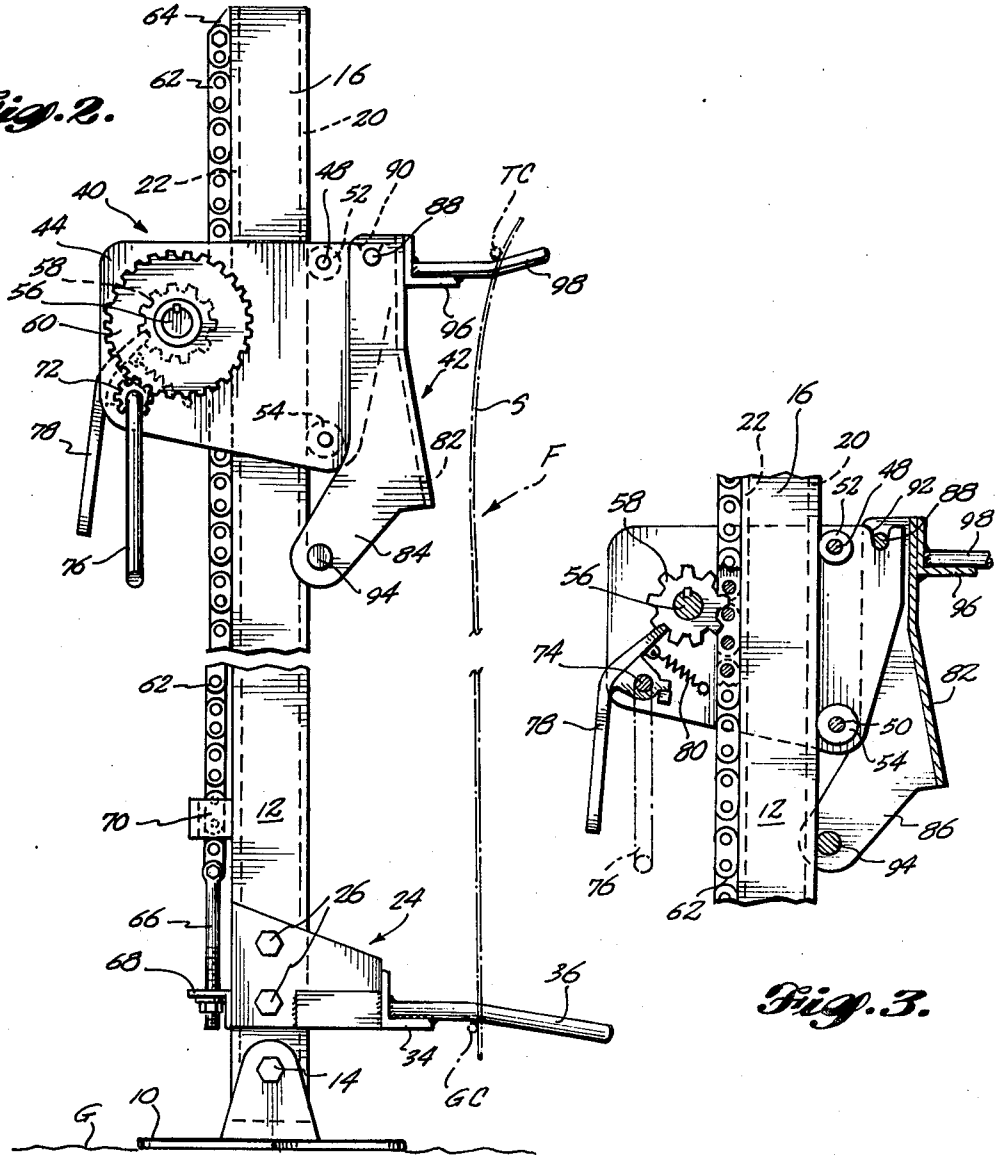
Fig. 2.
Fig. 3.
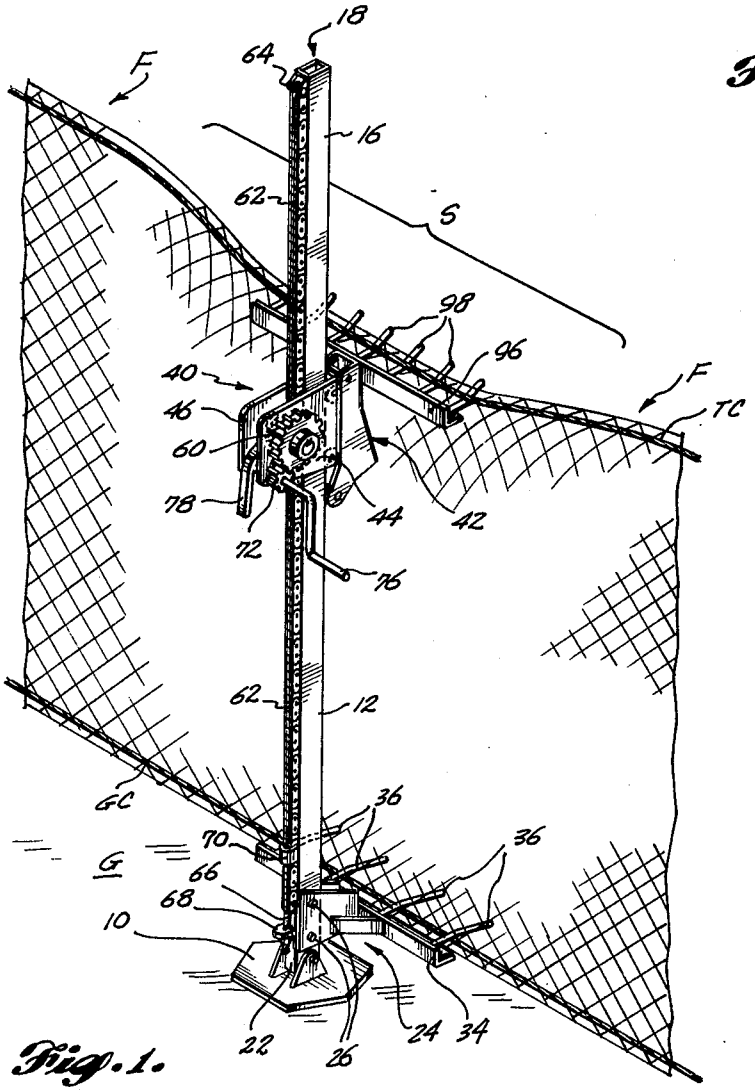
Fig. 1.

CHAIN LINK FENCE STRAIGHTENER

BACKGROUND OF THE INVENTION

1. Field of the Invention

This invention relates to fence straightening apparatus, and more particularly to readily portable and manually operable apparatus for the straightening of bent chain link fence segments without removal of such segments from the line of fence.

2. Description of the Prior Art

Chain link fencing has become widely used for the corralling and pasturing of horses and the like. In a typical application for this purpose the chain link fencing of a height of 5 feet or so is strung from post to post along a fence line, with cables strung along the bottom of the fence at ground level and along the top of the fence, the chain links of the fencing being attached to the cables by hog rings or the like. In addition, an electrified wire is usually strung along and slightly above the top of the chain link fencing and top cable. As long as the electrified wire is operational it effectively prevents the fenced animals from damaging the fence. However, if the electrified wire is not energized for some reason, such as a continuity failure, the animals often attempt to reach grass on the other side of the fence or simply break out of the fence and as a result can bend the fence over to the extent the fence must be repaired or even replaced in order to again be effective for its purpose.

Straightening of chain link fence sections thus bent has proven to be a difficult and vexing task. Fence stretching devices, such as disclosed in Cisney U.S. Pat. No. 2,859,944, are ineffective to straighten a vertically bent chain link fence in that the stretching action of such a device is exerted horizontally while the bending of the fence occurs primarily in its vertical dimension. Conventional line and pulley fence stretchers are similarly ineffective in that there is simply no readily available way to operate such devices without a vertically fixed anchor point above the bent fence section, which of course is normally not available.

To the best of applicant's knowledge, no equipment has previously existed which will straighten chain link fence sections without removal of the section from the fence, and it is a primary object and feature of the present invention to provide such a device.

SUMMARY OF THE INVENTION

As indicated, it is a basic feature and advantage of the chain link fence straightener of the present invention that it can be used to straighten even severely bent chain link fence sections without removal of the section from the fence and regardless of where the bend or bends have occured in the fence, vertically considered.

It is a further advantage and feature of the chain link fence straightener of the present invention that it is relatively light and can be readily manually transported and manually operated at any fence section desired. As a related feature, portions thereof are readily disassemblable for handling and to facilitate transport from place to place and for storage.

Yet another feature and advantage of the chain link fence straightener of the present invention is that it is mechanically quite simple, yet sturdy and effective for its purpose. In its preferred form, it includes a rack gear means made up of a length of hardened steel chain links which are characteristically relatively light in weight and relatively inexpensive, with the further capability of being readily removable and repairable in that individual links may be readily replaced.

These and other objects, features, advantages and characteristics of the chain link fence straightener of the present invention will be apparent from the following more detailed description of a typical embodiment thereof.

BRIEF DESCRIPTION OF THE DRAWINGS

FIG. 1 is an isometric view of a chain link fence straightener according to the invention, shown in operation on a bent segment of a chain link fence;

FIG. 2 is a side elevational view on an enlarged scale, with portions broken away for clarity of illustration, of the chain link fence straightener shown in FIG. 1; and FIG. 3 is a further enlarged detail view, partially in cross section, further showing certain portions of the carriage and upper tine means of the fence straightener shown in FIGS. 1 and 2.

DESCRIPTION OF THE PREFERRED EMBODIMENT

As will be understood, the chain link fence straightener shown in the accompanying drawing serves the purpose of applying vertical tension to and thereby straightening more or less vertically bent sections or segments S of a chain link fence, generally designated F, of indeterminate length and previously strung along posts (not shown) implanted in the ground G. Such fences are commonly installed with a taut ground cable GC and taut top cable TC being joined to the bottom and top edges of the fence along the length or "line" thereof, by hog rings or the like. When such a top cable TC is on the fence F, it is of course desirable to slacken the top cable during fence straightening so that any selected particular fence segment S can be readily tensioned above the cable line during straightening and thereby be straightened more effectively. Since the straightener apparatus of the present invention is ground supported during use, as discussed in more detail below, and the lower portion of the fence is in effect anchored and retained at ground level during the straightening operation, there is normally no need to slacken the ground cable GC during the straightening operation.

As shown in the accompanying drawing, the preferred form of chain link fence straightener of the present invention comprises a base member 10 configured to engage the ground G over a substantial area, the base member 10 being rigidly attached to and supported by an upright post or standard 12, as by bolt means 14, the said post 12 being preferably of rectangular configuration in lateral cross section with its major dimension sides or faces 16, 18 extending generally laterally of the nominal plane of the fence section S and with its minor dimension sides or faces 20, 22 being respectively at the front and rear of the post 12 relative to the nominal plane of the fence section S, and being generally parallel thereto.

To anchor or restrain the lower edge of a bent fence segment S during straightening thereof, lower tine means, generally designated at 24, is rigidly attached as by bolt means 26 to the post 12 slightly above the base member 10. As shown, said lower tine means comprises side plates 28, 30, and laterally placed stiffener means, one of which is indicated at 32, rigidly joined to a cross bar 34 which in turn mounts a plurality of tines 36, which, as best shown in FIG. 1, are in relatively spaced relation to engage a corresponding plurality of links of the fence segment near the bottom thereof by being inserted through openings in the links, the said tines 36 preferably being configured to turn downward slightly at their forward ends (also note FIG. 2) to aid in retention of the lower portion of the fence segment S during its straightening. For uniform straightening action over a fence segment S of substantial area, it is considered that the tines 37 of the lower tine means 24 should be at least four in number and should span the distance of at least about 2 feet, horizontally along the fence line.

To exert a straightening tension on the fence segment S, with the lower portion thereof anchored by the lower tine means 24, the straightener apparatus shown is provided with a carriage means or carrier, generally indicated at 40, which is vertically movable along the upright post means 12 and supports what may be termed an upper tine means, generally indicated at 42. The carriage means 40 comprises side plates 44, 46 joined forwardly by upper and lower ends 48, 50 on which are journaled respective upper and lower rollers 52, 54 in engagement with the forward face 20 of the post 12, and joined rearwardly by shaft 56 to which are keyed pinion gear 58 (FIG. 3) and a first reduction gear 60. The pinion gear 58 is meshed with a rack gear means in the form of a length of preferably hardened steel chain links 62 arranged along the rear surface 22 of the post means 12 between an anchor lug 64 at the upper end of the post means 12 and a bolt means 66 passed through a lower lug 68, in turn affixed, as by weldment, to the post rear surface 22 near the lower end thereof. As will be understood, said bolt means 66 provides for adjustment of the extent of tension on, or removal of, the length of chain made up by the links 62. A guide sleeve 70, as best shown in FIG. 2, is also affixed as by weldment to the post rear face 22 near the lower end of the length of chain links 62 to restrain the extent of lateral movement of the tensioned length of chain links 62. As will be recognized, the use of a length of chain links 62 in the arrangement shown, to serve as the rack gear means of the straightener apparatus, provides a lightweight, inexpensive, and readily repairable or replaceable component in a portion of the apparatus often subject to a considerable amount of strain and wear during prolonged use.

The meshed pinion gear 58 is suitably manually driven through its mounting shaft 56 and the first reduction gear 60 by means of second reduction gear 72 keyed to the shaft 74 of hand crank 76 and in mesh with the gear 60. In a manner conventional per se, the pinion gear 58 is selectively and releasably restrained from rotation, and the carriage 40 is thus selectively lockable and restrained with respect to relative movement along the rack gear means and thus the post means 12, by pivotally mounted lock latch 78, suitably normally urged to locking engagement with the pinion gear means 58, as by tensioned spring means 80.

The upper tine means 42 comprises a front panel 82 joining side plates 84, 86 which in their upper portions carry pin 88 removably engageable with notches 90, 92 in the top edges of the carriage side plates 44, 46. Said side plates 84, 86 of the upper tine means 42 also carry in the lower portions thereof a transverse pin 94 positioned to directly engage and ride along the forward surface 20 of the post means 12 when the upper tine means 42 is in its use position. Affixed, as by weldment, to the upper portion of the front face 82 is a cross bar 96 on which is mounted a plurality of upper tines 98 which, as best shown in FIG. 1, are in relatively spaced relation to engage a corresponding plurality of links of the fence segment above the bottom of the links engaged by the bottom tines 36, by being inserted through openings in the links, the said upper tines 98 preferably being configured to turn upward slightly at their forward ends (also note FIG. 2) to aid in retention of the upper portion of the bent fence segment S during its straightening. For uniform straightening action over a fence segment S of substantial area, it is considered that the tines 98 of the upper tine means 42 should be at least four in number (six being actually employed in the preferred embodiment shown) and should span a distance of at least about 2 feet horizontally along the fence line.

Since some degree of vertical elongation is often involved in the course of "stretching" the bent fence segment S back into substantially its original shape, it will be understood that the post means 12 is to be at least as high as the nominal height of the fence being straightened and, as a practical matter, somewhat taller than the fence height, e.g. have a length dimension of at least 6 feet for use on a 5 foot fence.

Turning to a consideration of the operation and manner of use of the fence straightener illustrated in the accompanying drawing, it will be understood that the device is normally manually carried along a line of chain link fencing with the upper tine means disengaged from the carriage means, as a matter of convenience. Upon locating a bent fence segment to be straightened, and disconnecting the upper cable TC of the fence in the portion thereof occupied by such segment, the base member 10 of the straightener is placed on the ground next to the bent segment S and in a position so that the lower tines 36 extend through lower links of the segment substantially in the position shown in FIG. 2. By appropriate cranking of the hand crank 76, the operator then sets the carriage 40 at a position on the post 12, to take as much of a "bight" of the bent segment, vertically considered, as is possible consistent with the requirement that the upper tines 98 be inserted into chain links of the bent fence segment above the lower tines 36 and the tine means 42 then be placed in supported position on the carriage 40. When this location of the carriage 40 is determined and arrived at, the upper tines 98 are then inserted into the bent segment links and the upper pin 88 is placed on the notches 90, 92 of the carriage 40 and with the lower pin 94 in engagement with the forward surface 20 of the post 12. It is a major advantage of the fence straightener apparatus shown that the removable upper tine means 42 is separately placeable in the upper portion of the bent fence segment and can then be placed on the carriage 40 by appropriate manipulation of the fence segment engaged by the tines 98. With the upper tine means thus in place, the hand crank 76 is rotated to move the carriage upwardly on the post, placing the fence segment portion between the lower and upper tines 36, 98 in tension sufficient to straighten or essentially straighten the particular links thereof across the full height of the fence. In practice, some degree of overtensioning is of course appropriate so that when the tension is released on the links between the upper and lower tines the vertical dimension of the fence segment will have approximately its original shape and dimension. The upper tines 98 are then withdrawn and the straightener moved to an adjacent panel of the fence segment to be straightened, and so on. Thus, through a sequence of one or more tensioning and straightening "bights" being taken horizontally, the entire bent segment is straightened or essentially so, whereupon the top cable TC (if present) is retensioned and reconnected and the straightener apparatus is withdrawn and moved to operative position at the next bent fence segment.

From the foregoing, various further applications, modifications and adaptations of the apparatus disclosed and the invention embodied therein will be apparent to those skilled in the art to which the invention is addressed, within the scope of the following claims.

What is claimed is:

1. A chain link fence straightener for straightening a bent segment of previously installed chain link fence without removal of the segment from the line of fence, said straightener comprising:

a. a ground engageable base member;

b. post means standing upwardly from said base member to a height at least about the normal height of the fence;

c. lower tine means of at least about a 2 foot span affixed to said post means and extending forwardly thereof slightly above said base member in a position for engaging with at least about four tines a plurality of links of the fence segment near the bottom thereof;

d. carriage means which enclose said post means while being carried thereby and relatively movable therealong;

e. manually actuated drive means carried by said carriage means for moving said carriage means vertically on said post means, and for retaining said carriage means at any desired position on said post means; and f. upper tine means of at least about a 2 foot span carried by said carriage means and extending forwardly thereof in a position for engaging with at least about four tines a plurality of links of the fence at various points above said lower tine means.

2. A fence straightener according to claim 1, wherein substantially the full length of said post means is of rectangular cross section and said carriage means is of like internal configuration.

3. A fence straightener according to claim 2, wherein said post means includes a rack gear mounted on the rear surface of said post means.

4. A fence straightener according to claim 2, wherein said carriage means includes vertically spaced roller means located internally of the carriage means and engaging the forward exterior surface of said post and said upper tine means includes a laterally disposed pin in its upper portion engaging notch means on said carriage means forwardly of said roller means.

5. A fence straightener according to claim 1, wherein said upper tine means is readily removable from said carriage means.

6. A chain link fence straightener for straightening a bent segment of previously installed chain link fence without removal of the segment from the line of fence, said straightener comprising:

a. a ground engageable base member;

b. an upright post attached to said base member and upstanding therefrom to a height at least about the normal height of the fence;

c. lower tine means of at least about a two foot span affixed to said post and extending forwardly thereof slightly above said base member in a position for engaging with at least about four tines a plurality of links of the fence segment near the bottom thereof;

d. rack gear means extending along the rear of said post from about the top thereof to near the bottom thereof;

e. a carriage snugly surrounding said post and relatively movable therealong, and on which is journaled a shaft mounted pinion gear means in operative engagement with said rack gear means at the rear of said post;

f. upper tine means of at least about a 2 foot span on said carriage and extending forwardly thereof in a position for engaging with at least about four tines a plurality of links of the fence at various points directly above said lower tine means;

g. means for rotating said pinion gear means and causing movement of it, said carriage, and said upper tine means vertically along said post, and including means for selectively locking said pinion gear means against rotation.

7. A fence straightener according to claim 6, wherein substantially the full length of said post is of rectangular cross section with its major cross-sectional dimension extending substantially perpendicular to the plane of said fence.

8. A fence straightener according to claim 6, wherein said rack gear means is made up of a length of hardened steel chain links.

9. A fence straightener according to claim 8, wherein said rack gear means is readily detachable from said post and further comprises a threaded anchor bolt at the lower end thereof with an engaged nut on the bolt for adjusting the extent of tension on said length of chain links.

10. A fence straightener according to claim 7, wherein said carriage includes vertically spaced roller means located internally of the carriage means and engaging the forward exterior surface of said post and said upper tine means includes a laterally disposed pin in its upper portion engaging notch means on said carriage forwardly of said roller means.

11. A fence straightener according to claim 6, wherein said upper tine means is readily removable from said carriage.

12. A fence straightener according to claim 6, wherein said means for rotating said pinion gear means comprises reduction gearing and a hand crank rotatable about a horizontal axis.

13. A chain link fence straightener for straightening a bent segment of previously installed chain link fence without removal of the segment from the line of fence, said straightener comprising:

a. a ground engageable base member;

b. post means ending upwardly from said base member to a height at least about the normal height of the fence;

c. lower tine means of substantial horizontal span affixed to said post means and extending forwardly thereof slightly above said base member in a position for engagement with a plurality of links of the fence segment near the bottom thereof;

d. carriage means carried by said post means and relatively movable therealong;

e. manually actuated drive means carried by said carriage means for moving said carriage means vertically on said post means, and for retaining said carriage means at any desired position on said post means; and f. upper tine means carried by said carriage means and extending forwardly thereof in a position for engagement with a plurality of links of the fence at various points above said lower tine means, wherein said upper tine means engages an upward portion of said carriage means disposed forwardly of said post means and in its lower portion includes roller means that bear directly against the forward surface of said post below said carriage wherein said roller means carries a substantial portion of the weight borne by the tine means.

14. A fence straightener according to claim 13, wherein said upper tine means is readily removable from said carriage.

15. A chain link fence straightener for straightening a bent segment of previously installed chain link fence without removal of the segment from the line of fence, said straightener comprising:

a. a ground engageable base member;

b. an upright post attached to said base member and upstanding therefrom to a height at least about the normal height of the fence;

c. lower tine means of substantial horizontal span affixed to said post and extending forwardly thereof slightly above said base member in a position for engagement with a plurality of links of the fence segment near the bottom thereof;

d. rack gear means extending along the rear of said post from about the top thereof to near the bottom thereof;

e. a carriage snugly surrounding said post and relatively movable therealong, and on which is journaled a shaft mounted pinion gear means in operative engagement with said rack gear means at the rear of said post;

f. upper tine means of substantial horizontal span on said carriage and extending forwardly thereof in a position for engagement with a plurality of links of the fence at various points directly above said lower tine means, wherein said upper tine means engage an upward portion of said carriage disposed forwardly of said post and in its lower portion bears directly against the forward exterior surface of said post below said carriage; and g. means for rotating said pinion gear means and causing movement of it, said carriage, and said upper tine means vertically along said post, and including means for selectively locking said pinion gear means against rotation.

* * * * *